United States Patent [19]

Shaw

[11] Patent Number: 4,712,626

[45] Date of Patent: Dec. 15, 1987

[54] RETAINER DEVICE FOR DRILL BIT

[75] Inventor: Ray H. Shaw, Willowick, Ohio

[73] Assignee: Mining Tools, Inc. Div. of Smith California, Mentor, Ohio

[21] Appl. No.: 250,290

[22] Filed: Apr. 2, 1981

[51] Int. Cl.[4] ..... E21B 10/58; E21B 10/62

[52] U.S. Cl. ..... 175/410; 76/108 A; 175/418

[58] Field of Search ..... 175/213, 418, 410, 320; 76/108 R, 108 A

[56] References Cited

U.S. PATENT DOCUMENTS

| | | | |
|---|---|---|---|
| 3,415,332 | 12/1968 | Bower, Jr. | 175/418 |
| 3,434,553 | 3/1969 | Weller | 175/418 |
| 3,434,554 | 3/1969 | Bower, Jr. | 175/410 |
| 4,099,585 | 7/1978 | Emmerich | 175/320 |
| 4,356,873 | 11/1982 | Dziak | 175/410 |

FOREIGN PATENT DOCUMENTS

| | | | |
|---|---|---|---|
| 160317 | 12/1954 | Australia | 175/410 |
| 664983 | 1/1952 | United Kingdom | 175/410 |
| 668810 | 3/1952 | United Kingdom | 175/410 |

*Primary Examiner*—Stephen J. Novosad

*Attorney, Agent, or Firm*—Watts, Hoffmann, Fisher & Heinke Co.

[57] ABSTRACT

A retainer device of the type for securing by brazing or the like a carbide cutting element to a drill bit body of the type including head portion having a transverse slot formed therein to receive the carbide element, the retainer device including a unitary, one-piece body made from a consumable, non-ferrous brazing metal defined by a base portion and a pair of integral, oppositely disposed main portions extending upwardly therefrom and adapted to receive the carbide element therebetween. A pair of integral tab portions extend upwardly from the base portion adapted to prevent lateral shifting movement of the carbide element, and a pair of flange portions are made integral with and extend outwardly from opposed ends of the wing portions adapted to prevent lateral shifting movement of the container device when disposed in the slot in the head portion.

13 Claims, 11 Drawing Figures

RETAINER DEVICE FOR DRILL BIT

DESCRIPTION

1. Technical Field

The present invention relates to drill bits and more specifically to drill bits of the type used in drilling operations, such as in roof drilling operations in coal mines or the like. The tool bit of the present invention relates generally to the type of bit described in applicant's co-pending application filed Dec. 10, 1980 under Ser. No. 186,204, now U.S. Pat. No. 4,313,506.

2. Background Art

Conventionally, in prior art drill bits the carbide cutting element is fixed to the drill body by brazing or the like. In past practice, a generally U-shaped copper clip or shim has been placed between the element and the drill body so that the legs of the equipment is bent between the plane or sides of the cutting element and the side surfaces defined by a transverse slot formed in the drill body. During the fabrication operation, the copper clip is brazed to the drill body thereby fusing the carbide element to the drill body. In such case, a brazing material such as a brazing rod element is utilized to braze the clip to the drill body and, heretofore, has not been made from a consumable alloy material which itself constitutes the brazing material.

In order to maximize drilling efficiency, the center line of the carbide element should be coincident with the rotational axis of the drill body. Heretofore, in the prior art clips described above did not insure alignment between the cutting element and the drill body. Centering of the component parts was done during assembly by the workmen and as should be apparent, a great deal of time and effort was required. In general, the cutting elememt was aligned during the brazing operation by manually tapping the side of the element until it appeared visually aligned with the drill body. This tedious task was done while the components were heated to relatively high temperatures and moreover, was basically a trial and error operation, dependent primarily on the skill of the workmen. These and other such disadvantages with the prior art devices are described in the aforementioned application Ser. No. 186,204, now U.S. Pat. No. 4,313,506.

DISCLOSURE OF THE INVENTION

The present invention provides a new and improved method and retainer device for securing a cutting element (i.e., carbide) to the drill body. The present invention is particularly useful in assembly of drill bits used for coal mining operations or the like. According to the invention, a retainer device is provided that automatically centers the cutting element within a transverse slot formed in the drill body and maintains the axial alignment of the two elements during the brazing operation until the brazing alloy liquid temperature is reached. Hence, the present invention obviates the need for highly skilled workmen without sacrificing quality of construction of the finished tool bit. More specifically, in the invention the retaining device is made from a consumable, nonferrous metallic material which provides the brazing material for securement of the components together. In effect, the carbide cutting element is automatically secured without the need to employ separate brazing rods, brazing pastes, or the like.

In a preferred embodiment, the retainer device includes a unitary, one-piece body made from a consumable, non-ferrous brazing material, said body being defined by a base portion and a pair of integral, oppositely disposed wing portions extending upwardly therefrom and adapted to receive said carbide element therebetween. A pair of integral tab portions extend upwardly from said base portion adapted to prevent lateral shifting movement of said carbide element, and a pair of flange portions are made integral and extend outwardly from opposed ends of said wing portions adapted to prevent lateral shifting movement of said retaining device when disposed in the transverse slot provided in said head portion. Accordingly, the retainer device is constructed from a consumable, non-ferrous material that acts to provide a good brazing bond to permanently attach the carbide element to the drill body. Accordingly, the present invention provides a retainer device that not only serves as a means for locating and maintaining the alignment of the carbide element relative to the drill body during the attachment process, but also the device itself is made from a consumable, nonferrous brazing material that enables, in effect, the carbide element to be secured in situ without the need for ancillary brazing rods, pastes, or the like.

Additional features and a fuller understanding of the invention will be obtained in reading the following detailed description made in connection with the accompanying drawings.

BRIEF DESCRIPTION OF THE DRAINGS

BEST MODE FOR CARRYING OUT THE INVENTION

Figure 3:
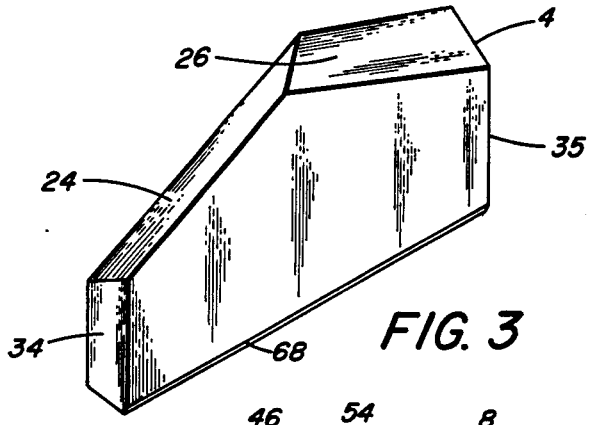
FIG. 3 is a generally perspective view of the carbide element.
Figure 1:
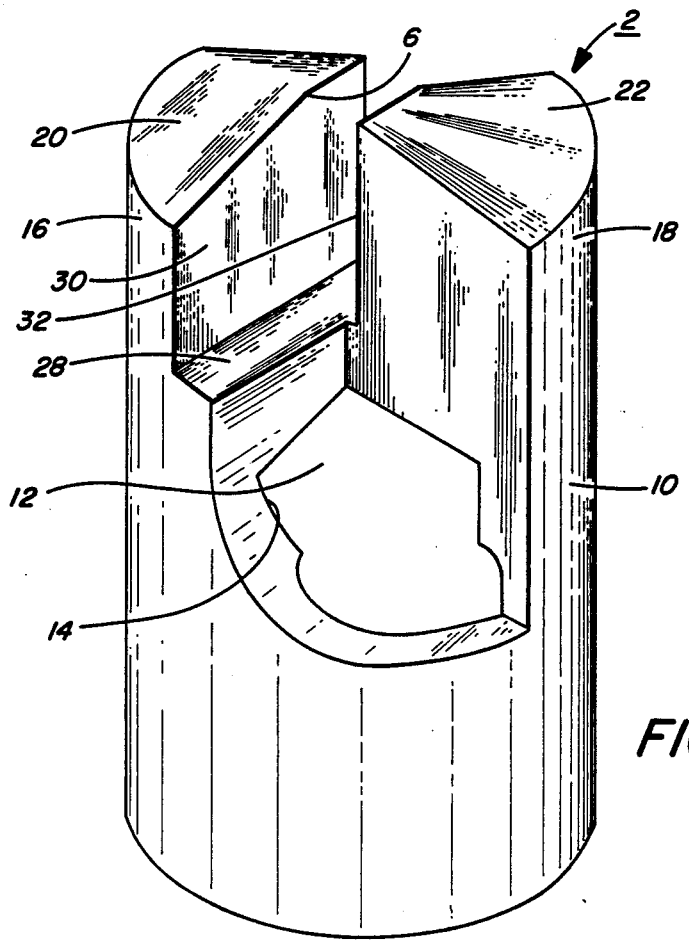
FIG. 1 is a generally perspective view, on an enlarged scale, of the body of a drill bit made in accordance with the invention.

Referring again to the drawings and in particular to FIGS. 1 and 3 thereof, there is illustrated a drill bit member, designated generally at 2, for mounting a workpiece element for in a transverse slot, designated generally at 6, for use in various drilling operations, such as in roof drilling in coal mines or the like. In the invention, the drill bit member 2 may be of the type commercially available on the market under the trademark "DUST HOG" from the Hughes Tool Company, Inc. Other drill bits having a solid body or head may be employed as described in U.S. Pat. No. 3,187,825 which is indicated by reference herein.

Now in the invention, the carbide element 4 is mounted on the drill bit member 2 by means of a novel retainer device, designated generally at 8, which is of a consumable construction and made from a nonferrous metallic material. Accordingly, the carbide element 4 is received within the retainer device 8 and centered within the slot 6 provided in the drill bit member 2, as will be more fully described hereinafter.

The drill bit member 2 includes an elongated cylindrical body 10 having a central bore 12 which communicates with dust-receiving openings or passages 14 for removing slurry materials during the drilling operation. The body 10 has a pair of upstanding generally oppositely disposed integral web portions 16 and 18 which define the transverse slot 6 therebetween. The web portions 16, 18 are provided with generally conical work surfaces 20, 22 which taper downwardly and outwardly in generally complimentary relationship in respect to the associated inclined cutting edge surfaces 24 and 26 provided on the carbide element 4. The transverse slot 6 is defined by a flat bottom 28 and a pair of oppositely disposed flat side walls 30, 32 which have a transverse spacement defined by the flat bottom surface 28 slightly greater than the corresponding transverse dimension, as at 34, giving the width of the carbide element 4. The width of the transverse slot 6 is substantially the same as the corresponding transverse width of the retainer device 8 so that the retainer device is frictionally yet slidably received within the slot 6 to facilitate assembly thereof.

Figure 2:
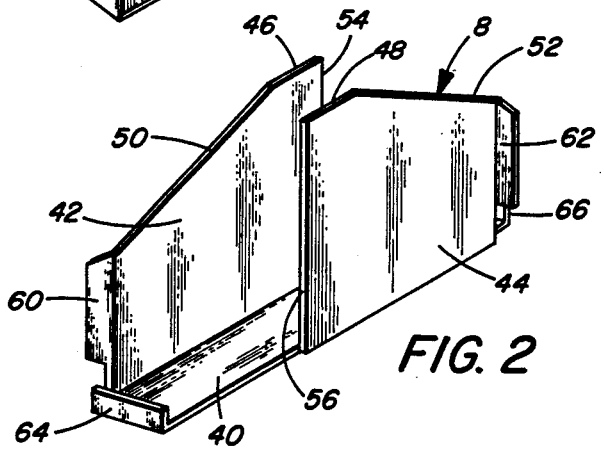
FIG. 2 is a generally perspective view of the retainer device for mounting the piece (carbide) made in accordance with the present invention.
Figure 4:
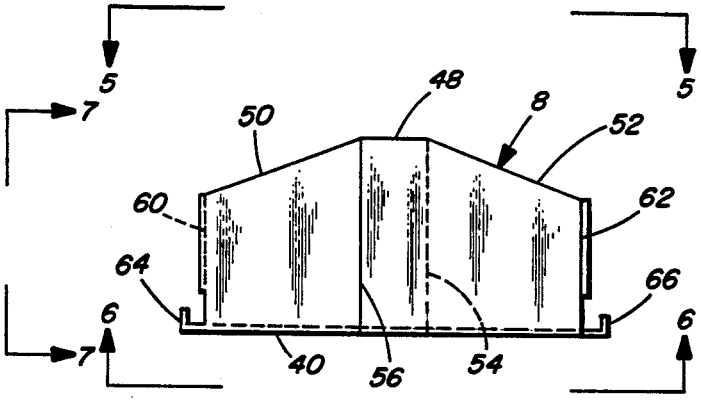
FIG. 4 is a side elevation view of the retainer device in accordance with the present invention.
Figure 5:
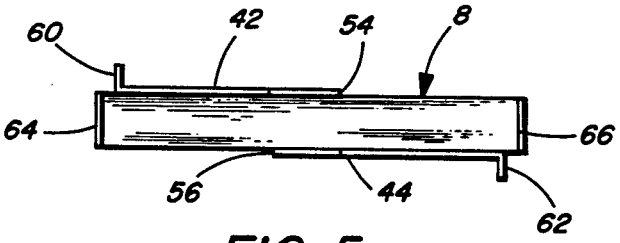
FIG. 5 is a top plane view looking along the line 5—5 of FIG. 4.
Figure 6:
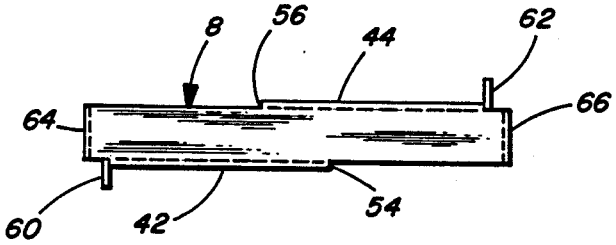
FIG. 6 is a bottom plane view looking along the line 6—6 of FIG. 4.
Figure 7:
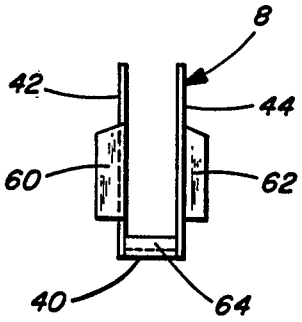
FIG. 7 is an end elevation view looking along the line 7—7 of FIG. 4.

In accordance with the invention, the retainer device 8 is of a generally U-shaped configuration defined by a flat base portion and a pair of oppositely disposed, integral, upstanding side wings 42, 44 which are laterally off-set from one another, as best illustrated in FIG. 5. The wings 42, 44 are preferably of an identical construction having planar top edges 46 and 48 and downwardly inclined edges 50, 52 which generally correspond to the inclination of the cutting surfaces 24, 26 on the carbide element 4. Accordingly, the wings 42, 44 have vertical end edges 54, 56 which are laterally off-set from one another as best seen in FIGS. 2, 4, 6. Accordingly, the wing members 42, 44 are generally shaped and sized to correspond to the corresponding shape and size of the side walls 30, 32 defining the transverse slot 6 of the drill bit member 2.

In the embodiment illustrated, the wing members 42, 44 are provided with integral, oppositely bent flanges 60, 62 which extend downwardly from the inclined edges 50, 52 and are spaced upwardly from the bottom portion 40. The flanges 60, 62 define with the wing members 42, 44 a generally L-configuration in top plan view, as best illustrated in FIG. 5. In the invention, the flanges 60, 62 project outwardly a distance sufficient to provide a gripping and guiding action on the corresponding exterior surfaces of the web portion 16, 18 of the drill bit member 2 to prevent lateral shifting movement of the retainer device 8 when installed within the transverse slot 6.

Now in the embodiment illustrated, the flat bottom surface 40 of the retainer device 8 includes an integral, upstanding pair of tab portions 64, 66 which together with the bottom surface define generally L-shaped configurations, in side elevational, as best illustrated in FIG. 4. These tab portions 64, 66 have a height sufficient to provide a gripping and retaining action with the corresponding end surfaces 34, and 35 of the carbide element 4 and hence, coact therewith to prevent lateral shifting movement on the carbide element 4 in the installed position in the retainer device 8. The bottom portion 40 of the retainer device 8 has a length sufficient to accommodate the corresponding bottom surface portion 68 of the carbide element 4 so that the tab portions 64, 66 tightly grip the end surfaces of the carbide element, as foresaid.

In the invention, it is preferred that the retainer device 8 be made of a unitary, one-piece construction made from a consumable, non-ferrous material which provides a brazing material for permanently securing the carbide element 4 to the drill bit member within the transverse slot 6 therein. Preferably, in the invention, the retainer device 8 is made from a non-ferrous brazing material having as a major constitutent a non-ferrous metallic material, such as copper. Preferably, the non-ferrous material has a melting temperature of approximately 1,700° F. and a hardness of between about R45T43 or RB71 and R45T79 or RB97. Now in the invention, a typical example of a suitable composition would be, as follows:

EXAMPLE I

| | |
|---|---|
| Copper | 46–50% |
| Nickel | 9–11% |
| Lead | .05% |
| Aluminum | .01% |
| Phosphorous | .25% |
| Silicon | .04–.25% |
| Zinc | Balance |

By this arrangement, the retainer device 2 can be effectively utilized as a guide and a shim for centering and holding the carbide element during the brazing operation so as to secure the carbide element in axial alignment in respect to the longitudinal central axis of the tool bit member. Being of a consumable metallic material, the retaining device acts as the brazing composition so as to eliminate the need for the use of conventional type brazing elements such as rods, pastes or the like. Specifically, therefore, the consumable retainer device is, in effect, formed in situ during the brazing operation for securement of the carbide element to the tool bit member.

In the invention, the retainer device can first be preassembled with the carbide element or the retainer device can be installed in the transverse slot in the tool bit member and the carbide element thereafter inserted within the retainer device. In either application, the retaining device operates to automatically center the carbide element with respect to the tool bit member and prevents lateral shifting movement of the carbide element during the brazing operation. This installation and automatic centering eliminates the need for manual and visual centering by the assembler of the finished drill bit. In addition, the retainer device is dimensioned so as to provide the necessary shim for supporting the carbide element in the proper centered relation with respect to the conical work surfaces of the tool bit member.

Figure 8:
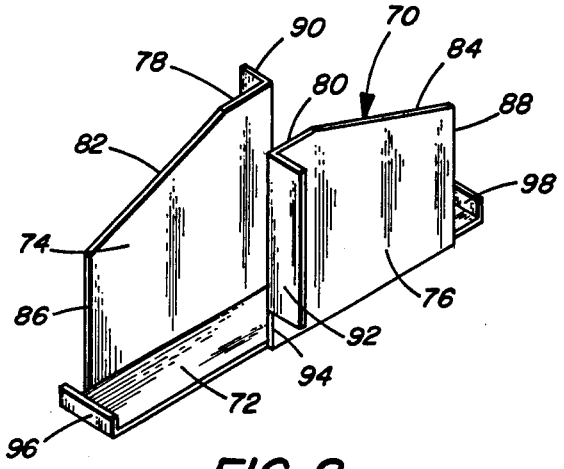
FIGS. 8–11 illustrate modified forms of the retainer device made in accordance with the invention.

In FIG. 8, there is illustrated a modified form of the retainer device designated generally at 70 which includes an elongated flat or planar base 72 with a pair of integral upstanding side wings 74 and 76 which extend parallel to one another and which are laterally off-set from one another with the side wings 74 and 76 transversely spaced so as to slidably accommodate the carbide element 4 therebetween. The base 72 terminates in oppositely disposed upstanding tab portions 96 and 98 which are spaced laterally from the opposed end edges 86 and 88 of the associated wing 74 and 76. The tab portions coact to prevent lateral shifting movement of the carbide element in the installed position. The wings 74 and 76 include inclined upper edge surfaces 82 and 84 which terminate generally in linear end surfaces 78 and 80. The wings are then provided with outwardly extending flange portions 90 and 92 which extend at right angles therefrom adapted for coacting engagement with the confronting exterior surfaces of the web portion 16 and 18 of the drill bit member 2 to prevent lateral shifting movement of the retainer device and hence the carbide element when installed in the transverse slot 6, as illustrated in FIG. 1.

Figure 9:
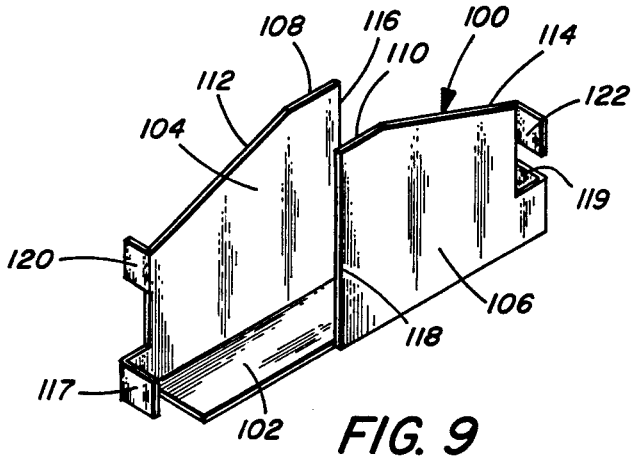

In FIG. 9 there is illustrated another modified form of the retainer device, designated generally at 100, which includes a generally planar or flat base portion 102 and a pair of upstanding, laterally spaced wing portions 104 and 106 which are laterally off-set from one another generally adjacent the mid-point of the base portions 102. The wing portion 104, 106 have linear extending upper edge surfaces 108 and 110 with downwardly inclined edge surfaces 112 and 114 and generally vertically extending end edges 116 and 118. In this form, the wing portions 104 and 106 include generally L-shaped, in top elevation, tab portions 117 and 119 which extend outwardly and then inwardly toward one another to provide a retainer to prevent shifting movement of the carbide element in the installed position. The tab portions 117 and 119 are made from the material of the wing portions 104 and 106 and extend substantially to the mid-point or longitudinal central axis of the base portion 102. The wing portions 104 and 106 then include outwardly extending integral flange portions 120 and 122 which have approximately the same widthwise dimension as the tab portions 117 and 119 for preventing lateral shifting movement of the retainer device in the installed position as aforesaid.

Figure 10:
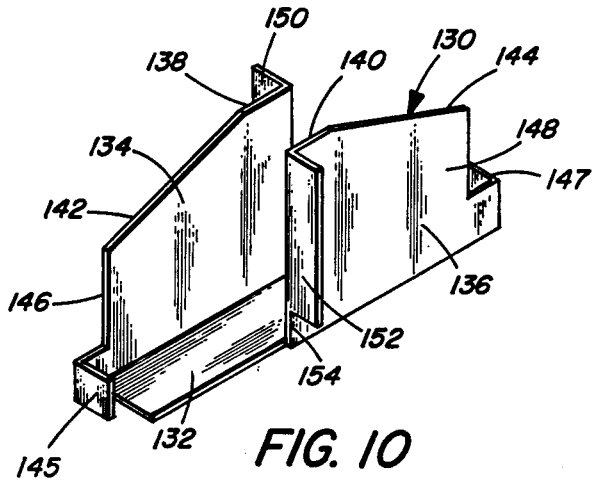

In FIG. 10 there is illustrated a still further modified form of the retainer device designated generally at 130, which includes an elongated flat or planar base portion 132. Here a pair of wing portions 134, 136 extend parallel and upwardly from the base portion 132 and include inclined upper edges 142, 144 and linear edges 138 and 140 and vertical edges 146 and 148. Hereagain, the wing portions include the generally L-shaped tab portions 145 and 147, but the flange portions 150 and 152 have the same general configuration as the flange portions 90 and 92 illustrated in FIG. 8. In this case, the flange portions as shown, terminate short of the base portion 132 as in the case of flange portions 90 and 92 in FIG. 8.

Figure 11:
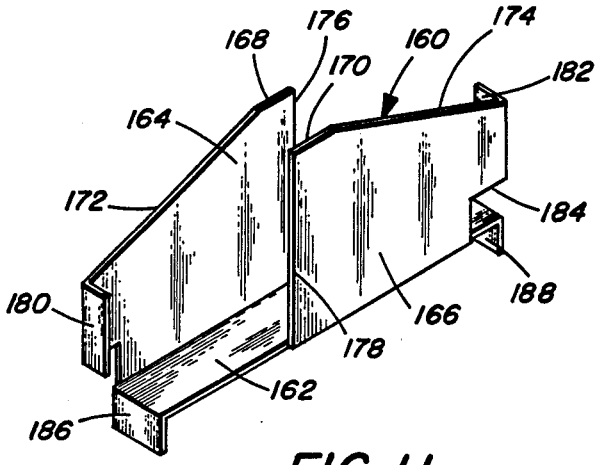

In FIG. 11 there is illustrated yet another modified form of the retainer device designated generally at 160, which includes a generally planar base portion 162 and a pair of upstanding, laterally spaced wing portions 164 and 166. The wing portions include the inclined upper edges 172, 174, the linear edges 168 and 170 and the vertical edges 176 and 178. In this form, the base portion 162 includes a pair of oppositely disposed downwardly extending flange portions 186 and 188 for gripping engagement with the outer confronting surfaces of the drill bit head in the installed position. In this embodiment, the wing portions 164 and 166 include inwardly extending flange portions 180 and 182 which extend from the opposite ends of the wing portions as compared to the flange portions illustrated in FIGS. 8 and 10.

From the various modifications illustrated in the foregoing description and illustrated in the accompanying drawings it will be seen that the retainer device can be made in various structural designs without departing from the spirit and scope of the present invention. Accordingly, such modifications are presented to illustrate various design types that are contemplated in the present invention. Other and further advantages of the invention will become apparent when taken in conjunction with the accompanying drawings and as set forth in the appended claims.

I claim:

1. A drill bit member comprising a drill bit body having a transverse slot adapted to receive a retainer device made from a consumable, non-ferrous metallic material adapted for receiving and securing by brazing a carbide element within the slot in said drill bit body, said retainer device is of a generally U-shaped configuration defined by a base portion and a pair of integral, oppositely disposed, upstanding wing portions adapted to receive said carbide element therebetween, said retainer device includes a pair of integral, oppositely disposed tab portions extending upwardly from said base portion adapted to prevent lateral shifting movement of the carbide element when disposed in said transverse slot, said retainer device includes a pair of integral, flange portions extending outwardly from said wing portions adapted to prevent lateral shifting movement of said retainer device within said transverse slot, said flange portions are spaced upwardly from said base portion, and said tab portions having a height less than the corresponding length of said flange portions.

2. A drill bit member in accordance with claim 1 wherein:

said drill bit body is of a hollow, cylindrical configuration including a head portion having said transverse slot and a body portion having dust collection passageway means formed therein and adapted to receive material drilled by said carbide element.

3. A drill bit member in accordance with claim 1 wherein:

said retainer device is made from a brazing alloy composition having copper as a major constitutent thereof.

4. A retainer device in accordance with claim 3, wherein:

said retainer device has a melting temperature of approximately 1,700° F. and a hardness in the range between R45T43 or RB71 and R45T79 or RB 97.

5. A drill bit member in accordance with claim 1 wherein:

said wing portions extend parallel to one another and are laterally off-set in relation to one another.

6. A drill bit member in accordance with claim 1, wherein:

said drill bit body is of a solid construction indicating a head portion having said transverse slot.

7. A retainer device in accordance with claim 1 wherein:

said retainer device is made from a non-ferrous brazing alloy composition having as the major constituent therein copper.

8. A drilling tool comprising: a body having a working end; prongs extending from said working end and forming a slot therebetween; a hard wear resistant insert; a braze fixture brazed to said prongs and to said insert; wherein said braze fixture comprises: a substantially flat base portion; a pair of arms extending substantially perpendicular to the plane of said base portion and on either side thereof; a first tab angularly extending from each of said arms and extending above and beyond its respective end of said base portion; said first tabs having oppositely facing abutment faces positioned so as to receive said insert between said abutment faces and keep said insert in a substantially fixed position; and a second tab extending downwardly from each respective end of said base portion with said second tabs having oppositely facing abutment faces, said abutment faces sliding over the outer dimension of said body and abutting against it so that said insert is now in a predetermined position with respect to said body.

9. A retainer devioe in accordance with claim 8 wherein:

said retainer device is made from a non-ferrous brazing alloy composition having as the major constituent therein copper.

10. A retainer device in accordance with claim 9 wherein:

said retainer device has a melting temperature of approximately 1,700° F. and a hardness in the range between R45T43 or RB71 and R45T79 or RB97.

11. A drilling tool comprising: a body having a working end; prongs extending from said working end and forming a slot therebetween; a hard wear resistant insert; a braze fixture brazed to said prongs and to said insert; wherein said braze fixture comprises: a substantially flat base portion; a pair of arms extending perpendicular to the plane of said base portion and on either side thereof; each arm having a first and a second tab angularly extending from the same end of said arm but in opposite directions with respect to said base portion, said first tab extending inwardly above and beyond an end of said base portion, said second tab extending outwardly from said base portion, said first and second tabs having abutment faces facing in the same general direction; and wherein said insert is fixedly positioned between the respective first tab abutment faces and the respective second tab abutment faces abut the outer periphery of said prongs so that said insert is now in a predetermined position with respect to said prongs.

12. A retainer device in accordance with claim 11 wherein:

said retainer device is made from a non-ferrous brazing alloy composition having as a major constituent therein copper.

13. A retainer device in accordance with claim 12 wherein:

said retainer device has a melting temperature of approximately 1,700° F. and a hardness in the range between R45T43 or RB71 and R45T79 or RB97.

* * * * *